US005281176A

United States Patent [19]

Yahagi et al.

[11] Patent Number: 5,281,176

[45] Date of Patent: Jan. 25, 1994

[54] CONTACT MEMBER WITH COMPOSITE SINTERED METAL PASTE STRIP HAVING 1-5 WT % CARBON DIFFUSION BONDED THEREIN

[75] Inventors: Shinichiro Yahagi, Obu; Keisuke Awazu; Osamu Kato, both of Kasugai; Takayoshi Shimizu, Ichinomiya; Tamotsu Nishinakagawa, Kuwana, all of Japan

[73] Assignee: Daido Tokushuko Kabushiki Kaisha, Japan

[21] Appl. No.: 917,490

[22] Filed: Jul. 21, 1992

[30] Foreign Application Priority Data

Jul. 22, 1991 [JP] Japan ..... 3-181214
Jul. 22, 1991 [JP] Japan ..... 3-181215

[51] Int. Cl.[5] ..... H01R 13/03

[52] U.S. Cl. ..... 439/887; 439/886; 439/930; 29/885; 29/DIG. 15

[58] Field of Search ..... 29/747, 826, 874–878, 29/882, 884, 885, 904, DIG. 15, DIG. 32; 148/400; 427/96, 97, 266, 269, 543; 428/901; 439/246, 775, 886, 887, 930

[56] References Cited

U.S. PATENT DOCUMENTS 2,289,708 7/1942 Jackson ..... 439/887 X
2,582,744 1/1952 Brennan ..... 29/885
4,179,322 12/1979 Brown et al. ..... 29/885 X
4,183,611 1/1980 Casciotti et al. ..... 439/887 X
4,398,975 8/1983 Ohsawa et al. ..... 148/400
4,461,785 7/1984 Oswald, Jr. ..... 427/543
4,767,672 8/1988 Fujinaka et al. ..... 427/97 X
4,980,245 12/1990 Marino ..... 439/887

FOREIGN PATENT DOCUMENTS 33861 2/1989 Japan ..... 439/887

*Primary Examiner*—Peter Dungba Vo
*Attorney, Agent, or Firm*—Davis, Bujold & Streck

[57] ABSTRACT

A contact member according to the invention effectively controls the production of sparks even at a high current, has a simple structure and is appropriate for use as a small contact brush as in a micromotor. A method of manufacturing a strip material for producing the contact member, the strip material being provided with a surface metal layer having a desired configuration which can be easily manufactured continuously, precisely and in large quantities with a high yield of contact members. Each of the contact members comprises a metal base plate and a sintered metal layer formed on a surface of the metal base plate. The contact member is cut from the strip material, which is manufactured by first printing a metal paste on desired positions on a metal base strip and then sintering the metal paste. The sintered metal layer is firmly joined to the metal base strip by diffusion bonding.

8 Claims, 9 Drawing Sheets

CONTACT MEMBER WITH COMPOSITE SINTERED METAL PASTE STRIP HAVING 1-5 WT % CARBON DIFFUSION BONDED THEREIN

BACKGROUND OF THE INVENTION

This invention relates to a process of making a composite strip for producing contact members, for example, a micromotor brush, a contact member including one made by the process and a composite strip, for producing the contact member, including a strip when made by the process, and particularly, though not exclusively, to a contact member and its strip material capable of operation without producing sparks.

This invention also relates to a method of manufacturing the contact member and the contact member strip material.

Conventionally, when a brush or other contact member is operated, sparks are produced, thereby fusing its contact point. To solve this problem, a known contact point comprises carbon, and following two methods of manufacturing the contact member by using carbon have been proposed.

In a first proposed method, carbon powder, a mixture powder of silver and carbon, or a mixture powder of copper and carbon is processed using a press into pieces having a desired configuration, and the pieces are then sintered. These sintered metal pieces are installed, and caulked in position, into engaging bores formed in a nickel silver plate or other metal base plate, thereby manufacturing motor brushes.

In a second proposed method, a mixture of silver, palladium and carbon is press-molded into small chips and the chips are sintered. As shown in FIG. 4A, such chips P1 are aligned on a nickel silver coil P2. The nickel silver coil P2 is clad with the chips P1 through cold rolling, thereby forming a contact member strip material P3. Subsequently, as shown in FIG. 4B, the contact member strip material P3 is cut into contact members each having a desired width. Thus motor brushes P4 are manufactured.

The aforementioned first method requires a step for embedding each sintered piece into each engaging bore in the nickel silver plate and this makes it difficult to manufacture small contact members like micromotor brushes. Furthermore, each sintered piece needs to be thick enough to be caulked and properly secured in each engaging bore. Each resulting motor brush has a large and heavy structure which generates vibration and noise. This method is inappropriate for manufacturing brushes for a micromotor having allowable current of 100 mA or less. On the other hand, the allowable current of the micromotor is generally restricted to 100 mA or less by the difficulty of securing small sintered pieces in the engaging bores using caulk. In view of the problems, the control of sparks in micromotors using carbon cannot be expected. Even when large contact members are manufactured by this method, the manufacturing steps of embedding the sintered pieces into the engaging bores in the nickel silver plate and caulking the pieces in position involve intricate handling of components. As a result, the manufacturing of inexpensive products in large quantities cannot be attained by this method.

In the second proposed method, as shown in FIG. 4A, when the sintered chips P1 are arranged on the nickel silver coil P2 and are then rolled, discontinuities P5 are formed among the chips P1. Therefore, as shown in FIG. 4B, when the nickel silver coil P2 is processed with a press into the motor brushes P4, a contact point P6 has discontinuities P5, and provides unreliable contact. If the motor brushes P4 having large discontinuities P5 are eliminated from the manufactured motor brushes P4, a yield will decrease. Furthermore, the second method involves intricate steps of sintering the chips P1 beforehand, and arranging and cladding the chips P1 on desired positions of the nickel silver coil P2. Such steps cannot be easily conducted continuously.

It is also known to produce contact members from a strip material comprising a metal strip clad with another metal strip. When these contact members are manufactured, as shown in FIG. 9A, a surface metal strip P20 is first laid on a base metal strip P10. Subsequently, as shown in FIG. 9B, the base metal strip P10 with the surface metal strip P20 is cold-rolled or hot-rolled with rollers P30 to join the base metal strip P10 and the surface metal strip P20 to each other to form the strip material. Consequently, the configuration of the contact members resulting from the strip material is limited. The strip material is inappropriate for manufacturing quad flat packages provided with terminals on their peripheries. When a strip material clad with a surface metal layer having various configurations other than the strip one is formed, the surface metal strip P20 is cut beforehand into desired configurations, and is then secured onto desired positions on the base metal strip P10 by spot welding, prior to the step of rolling with the consequent additional steps of preparatory cutting and spot welding being required. Consequently, the contact members clad with the surface metal layers of the desired configurations cannot be easily manufactured continuously, precisely and in large quantities.

SUMMARY OF THE INVENTION

An object of the present invention is to provide a contact member which is capable of operation without throwing off sparks even at a high current and is appropriate for use as a small contact such as a micromotor brush.

Another object of the invention is to provide a simple and easily effected method of manufacturing a contact member.

Another object of the invention is to provide a contact member strip material which can be easily manufactured continuously and assure a large yield.

Further object of the invention is to provide a method of manufacturing a contact member strip material provided with a surface metal layer having a desired configuration, which is easily performed continuously and precisely to produce large quantities of the material with a high yield.

To attain these or other objects, according to the invention there is provided a contact member comprising a metal base plate and a sintered metal layer, the metal layer containing carbon and being sintered, pressed and joined on desired positions of the metal base plate.

The desired positions of the metal base plate correspond to prepared portions on a surface of the metal base plate.

According to the invention there is also provided a contact member strip material comprising a strip-shaped metal base plate and a sintered metal layer containing carbon, the metal layer being sintered, pressed and joined onto the metal base plate and extending continuously along a length of the metal base plate.

The sintered metal layer is provided on prepared portions on a surface of the metal base plate.

The metal base plate is formed of nickel silver, phosphor bronze, alloy of beryllium and copper, or other copper alloy; stainless steels like SUS304, SUS301 or SUS631 steels (according to Japanese Industrial Standards); spring steels; or other elastic conductive material. As is known, nickel silver is a copper-base alloy containing zinc and nickel, while phosphor bronze is a copper-base alloy containing lead and zinc.

The sintered metal layer is formed of a mono-metal of gold, silver, platinum, palladium, or copper, or an alloy of mono-metals, containing at least 1% by weight of carbon. Thus formed sintered metal layer highly prevents sparks from being generated. The mono-metal or the alloy preferably contains at least 5% by weight of carbon. An alloy of 65% by weight of silver, 30% by weight of palladium, and 5% by weight of carbon is especially preferable.

When carbon occupies at least 10% of the surface area of the sintered metal layer, sparks can be precisely and stably prevented from developing. Carbon preferably occupies at least 50% of the surface area of the sintered metal layer.

BRIEF DESCRIPTION OF THE DRAWINGS

Various embodiments of the present invention will now be described, by way of example, with reference to the accompanying drawings, in which.

DETAILED DESCRIPTION OF PREFERRED EMBODIMENTS

FIRST EMBODIMENT

Figure 1:
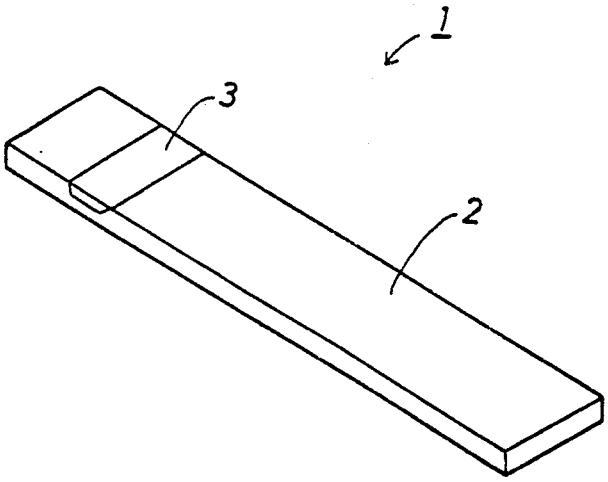
FIG. 1 is an isometric view of a motor brush of a first embodiment.

As shown in FIG. 1, a motor brush 1 comprises a metal base plate 2 of nickel silver and a sintered metal layer 3 as a contact area. The motor brush 1 has a length of 18 mm, a width of 3 mm, and a thickness of 0.1 mm. The sintered metal layer 3 is composed of about 65% by weight of silver, about 30% by weight of palladium and about 5% by weight of carbon. The sintered metal layer 3 extends transversely from side to side of the metal base plate 2, at a distance of 2 mm from one end of the motor brush 1, and is embedded in and flush with the metal base plate 2. The sintered metal layer 3 has a width of 1.6 mm and a thickness of 0.03 mm.

Figure 2:
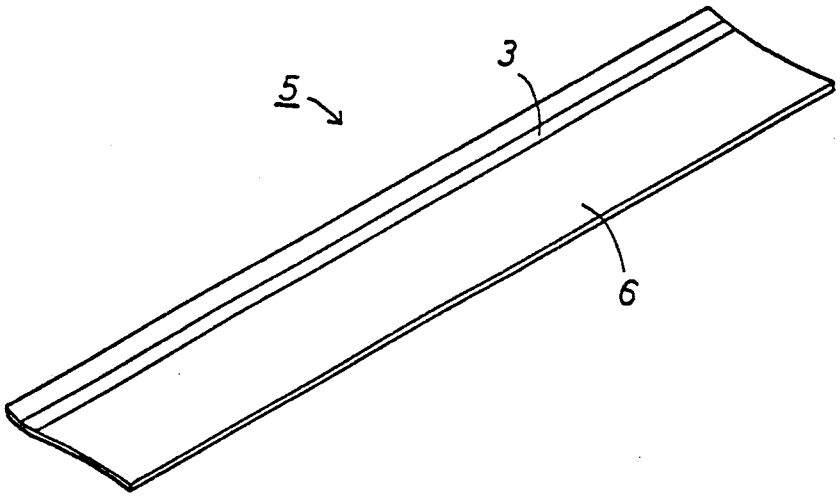
FIG. 2 is an isometric view partially cut away of a contact member strip material from which is manufactured the motor brush of the first embodiment.

As shown in FIG. 2, the motor brush 1 is formed by cutting a strip of contact member material 5, which comprises a nickel silver strip 6 having a width of 18 mm to form a plurality of the metal base plates 2. The sintered metal layer 3 is formed continuously along the length of the nickel silver strip 6.

Figure 5:
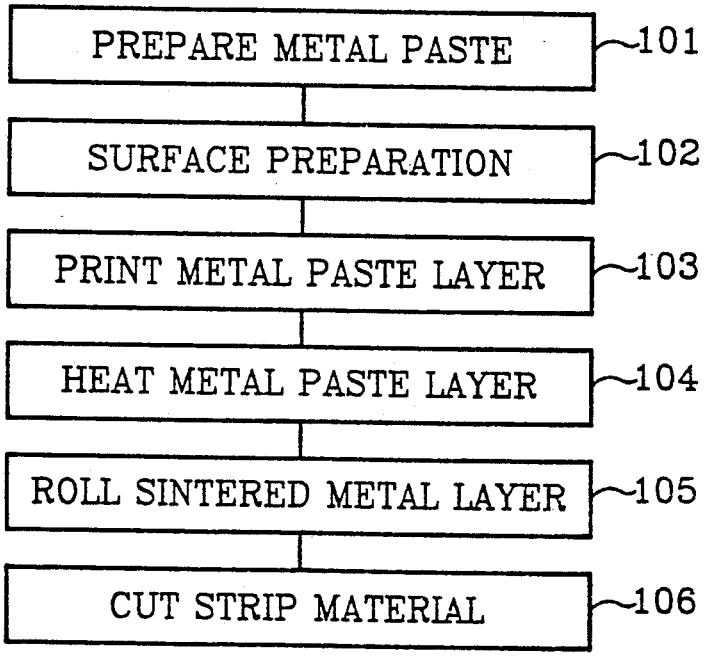
FIG. 5 is a flowchart showing the method of manufacturing contact members according to the present invention.

A method of manufacturing the motor brush 1 and the contact member material 5 will now be explained referring to FIGS. 3A-3E and the flowchart of FIG. 5.

At step 101, a metal paste is first prepared to form the sintered metal layer 3. The metal paste comprises a mixture of about 15% by weight of epoxy resin, about 15% by weight of butyl Carbitol, about 66.5% by weight of the coprecipitation powder of silver and palladium having a particle diameter of about 1 μm, and about 3.5% by weight of graphite powder having a particle diameter of about 6 μm. This mixture is kneaded with three rolling mills to form the metal paste. The coprecipitation powder of silver and palladium contains about 70% by weight of silver and about 30% by weight of palladium. A powder of silver and palladium alloy or a mixture of silver and palladium powders can also be used. The metal paste can alternatively contain gold, silver, platinum, palladium or other noble metals and mixtures thereof. Further, the epoxy resin can be replaced with cellulose, and the butyl Carbitol can be replaced with terpineol or an other solvent.

Subsequently, at step 102, the surface of the nickel silver strip 6 having a thickness of 0.14 mm is prepared so that the metal paste can be easily attached to the surface. Specifically, a hair line brushed finish is applied with a stainless wire brush to the entire width or only to the area to be coated with the metal paste, along the length of the nickel silver strip 6.

Figure 3A:
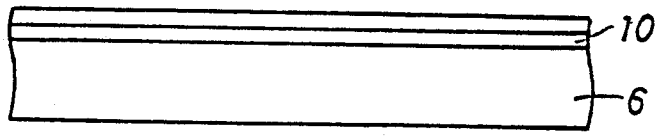
FIGS. 3A-3E are explanatory views of the steps of manufacturing the motor brush of the first embodiment.

At step 103, as shown in FIG. 3A, a metal paste layer 10 is printed on the surface of the nickel silver strip 6, by a known screen printing using as ink the metal paste prepared at step 101. Specifically, the strip-shaped metal paste layer 10 having a width of 1.5 mm and a thickness of 0.04 μm is printed along the length of the nickel silver strip 6. Instead of such printing, the metal paste layer 10 can be applied by using a roller.

Figure 3B:
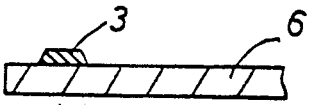

Subsequently, at step 104 of heating, the nickel silver strip 6, with the metal paste layer 10 formed thereon, is inserted into a cylindrical furnace, where the metal paste layer 10 is heated at about 900° C. for two hours in a non-oxidizing atmosphere, preferably an inert atmosphere such as argon. The metal paste layer 10 is thus sintered to form the sintered metal layer 3. At the same time, as shown in FIG. 3B, the sintered metal layer 3 is firmly joined to the nickel silver strip 6 by diffusion bonding.

Figure 3C:
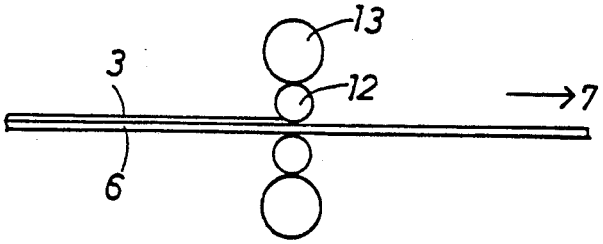
Figure 3D:
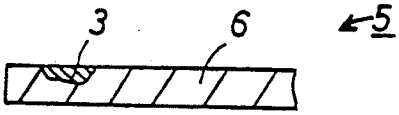

Subsequently, at step 105, the sintered metal layer 3 formed on the nickel silver strip 6 is rolled. Specifically, as shown in FIG. 3C, the sintered metal layer 3 formed on the nickel silver strip 6 is rolled between work rollers 12 and backup rollers 13 while being pulled in a direction shown by an arrow 7 at a draft of 30%. Draft is $100(T-t)/T(\%)$ where T is thickness before rolling and t is thickness after rolling. As shown in FIG. 3D, the resulting contact member material 5 has the sintered metal layer 3 embedded in and flush with the nickel silver strip 6. After being rolled, the nickel silver strip 6 has a thickness of 0.1 mm, while the sintered metal layer 3 has a depth of 0.03 mm, about 30% of the thickness of the nickel silver strip 6.

Figure 3E:
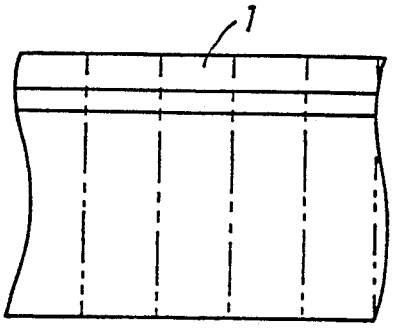

At step 106, the contact member material 5 rolled at step 105 is cut into individual motor brushes 1. Specifically, as shown in FIG. 3E, the contact member material 5 is cut across its width by pressing or other known method, such that each of the resulting motor brushes 1, as shown in FIG. 1, has a desired width of 3 mm.

Figure 4A:
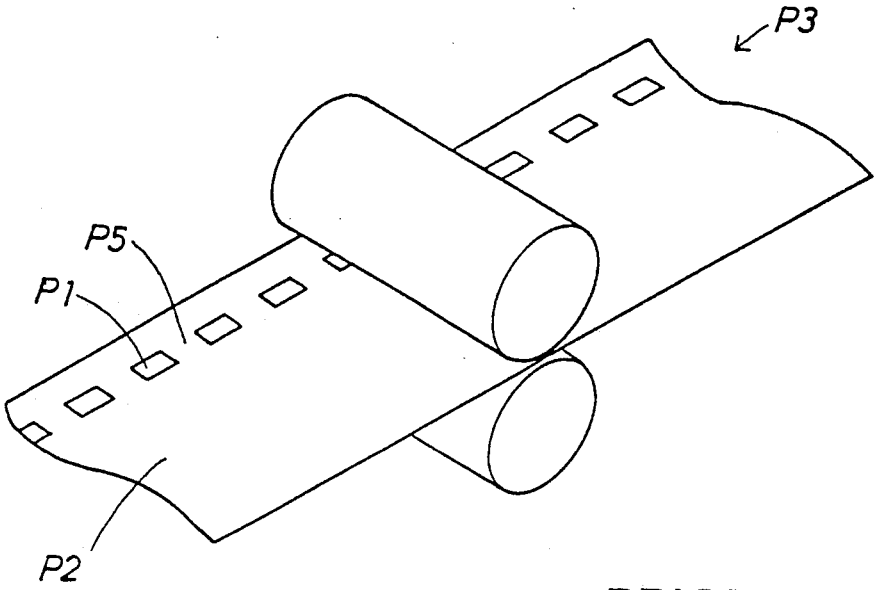
FIG. 4A PRIOR ART
FIGS. 4A and 4B are explanatory views explaining steps of manufacturing prior-art motor brushes.
Figure 4B:
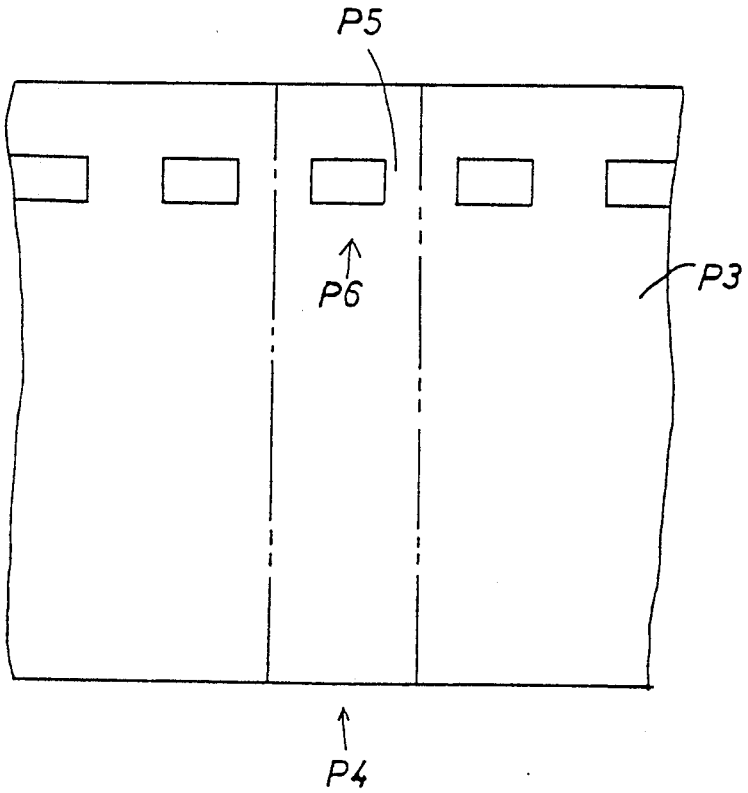
FIG. 4B PRIOR ART

As aforementioned, the motor brushes 1 of the first embodiment can be more easily manufactured than the prior-art motor brushes P4 shown in FIG. 4B which are manufactured by cladding the nickel silver coil P2 with the sintered pieces P1.

In the present method, by sintering the metal paste layer 10 while on the nickel silver strip 6, the sintered metal layer 3 is firmly joined to the nickel silver strip 6 forming the metal base plate 2.

Since the sintered metal layer 3 is configured by printing the metal paste layer 10 on the nickel silver strip 6, the size and configuration of such contact point can be determined as desired. Therefore, small and thin motor brushes for use in micromotors can be manufactured easily. The motor brushes 1, even if small-sized, can effectively control the development of sparks. As a result, the micromotors can have a greater allowable current than previously possible.

The sintered metal layer 3 extends from side to side of the resulting motor brush 1, without the discontinuities P5 of the prior-art motor brushes P4 shown in FIG. 4B. Thus, an improved yield of the motor brushes 1 can be achieved.

The sintered metal layer 3, even if containing less than about 5% by weight of carbon, can effectively control the production of sparks. However, more carbon is exposed on the surface of the sintered metal layer 3 containing about 5% by weight of carbon as compared with the sintered metal layer 3 containing 3% by weight of carbon. Generally, the sintered metal layer 3 needs to contain at least about 1% by weight of carbon to effectively control the production of sparks.

The contact member, according to the invention, can be of lightweight and have a desirable weight balance, thereby avoiding mechanical vibration. In addition, since the contact member contacts a micromotor shaft with only a low pressure, contact friction between the contact member and the micromotor shaft is minimized, thereby resulting in minimum wear and energy loss. The contact area between the contact member and the micromotor shaft is also minimized, thereby preventing excess current from being conducted and minimizing the power consumption of the micromotor.

The contact member according to the first embodiment of the invention can also be used as a relay contact point, which has minimum friction wear and energy loss.

SECOND EMBODIMENT

A method of continuously manufacturing IC lead frames of a second embodiment will now be described referring to the flowchart of FIG. 5 and explanatory views of FIGS. 6A–6C and 7A–7B. The manufacturing steps of the second embodiment are identical to those of the first embodiment. However, the second embodiment differs in, for example, material compositions and manufacturing conditions.

At step 101, a metal paste is prepared to form a sintered metal layer 219 described later. The metal paste material comprises a mixture of about 85.5% by weight of aluminum powder, about 4.5% by weight of carbon powder, about 2% by weight of butyl Carbitol as a binder and about 8% by weight of ethyl cellulose as further binder. The mixture is kneaded to form the metal paste.

Subsequently, at step 102, a surface of a metal base strip 201 described later is prepared so that the metal paste can be easily attached to the surface. The metal base strip 201 is composed of about 42% by weight of nickel and about 58% by weight of iron and has a thickness of 0.36 mm.

Figure 6A:
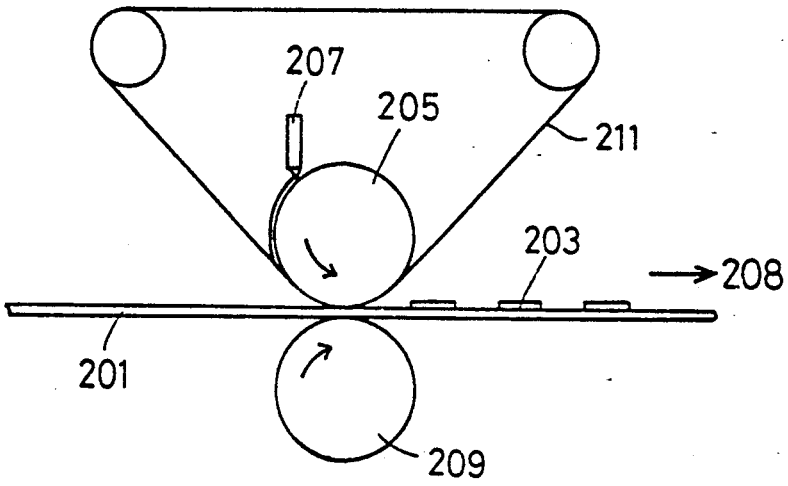
FIGS. 6A-6C and 7A-7B are explanatory views explaining steps of manufacturing an IC lead frame of a second embodiment.
Figure 6B:
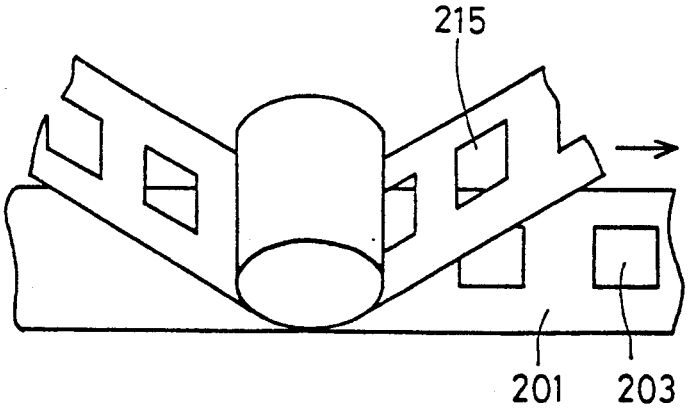

At step 103, a metal paste layer 203 is printed on the surface of the metal base strip 201. As shown in FIG. 6A, while applying the metal paste to an upper roller 205 with a brush 207, a resin sheet 211 and the metal base strip 201 are pressed together and fed in a direction shown by an arrow 208 between the upper roller 205 and a lower roller 209. As shown in FIG. 6B, square holes 215 are formed in desired positions of the resin sheet 211, such that the metal paste layers 203 form squares. When the upper and lower rollers 205 and 209 rotate to feed the metal base strip 201 and the resin sheet 211, the metal paste layers 203 are deposited on the surface of the metal base strip 201. The metal paste layers 203 have a configuration corresponding to that of the hole 215 and have a thickness between 4 μm and 20 μm. Instead of the aforementioned printing, the metal paste layer 203 can be formed on the surface of the metal base strip 201 by screen printing or the like.

Figure 6C:
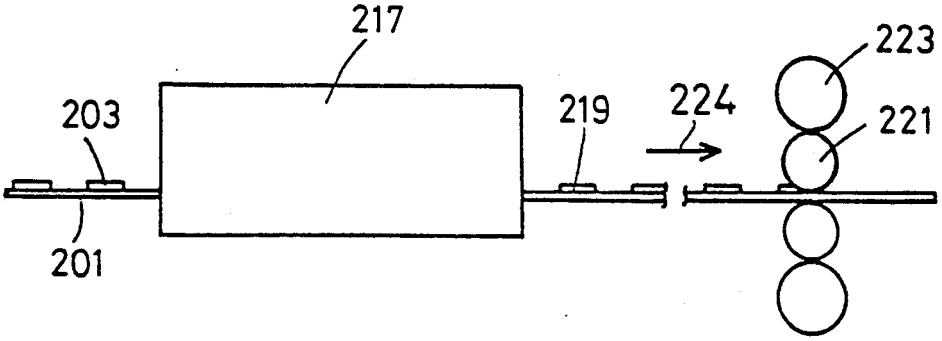

Subsequently, at step 104 of heating, as shown in FIG. 6C, the metal base strip 201 with the metal paste layers 203 formed thereon is passed through a cylindrically tubular furnace 217 for resistance heating or high-frequency heating, to heat the metal paste layers 203 at 900° C. for between 10 minutes and 60 minutes in non-oxidizing atmosphere such as nitrogen, helium, argon or other inert gas together, as appropriate, with hydrogen. The metal base strip 201 is fed through the furnace 217 for heating at a speed between one meter per minute and 10 meters per minute, and is then cooled at a room temperature for annealing. The metal paste layer 203 is thus sintered to form the sintered metal layer 219. At the same time, the sintered metal layers 219 are firmly joined onto the metal base strip 201 by diffusion bonding. During sintering the binders are eliminated and the sintered metal layer 219 is composed of about 95% by weight of aluminum and about 5% by weight of carbon.

Figure 7A:
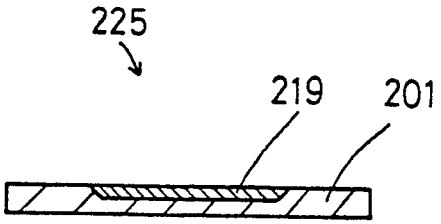

Subsequently, at step 105, the sintered metal layer 219 formed on the metal base strip 201 is rolled. Specifically, as shown in the right part of FIG. 6C, the sintered metal layers 219 formed on the metal base strip 201 are rolled between work rollers 221 and backup rollers 223 while being fed in a direction shown by an arrow 224 at a speed between one meter per minute and 10 meters per minute and at a draft of 30%. As shown in FIG. 7A, a resulting IC lead frame 225 has the sintered metal layer 219 firmly embedded in and flush with the metal base strip 201. After being rolled, the metal base strip 201 has a thickness of 0.25 mm, while the sintered metal layer 219 has a depth of 0.003 mm, about 1.2% of the thickness of metal base strip 201.

Figure 7B:
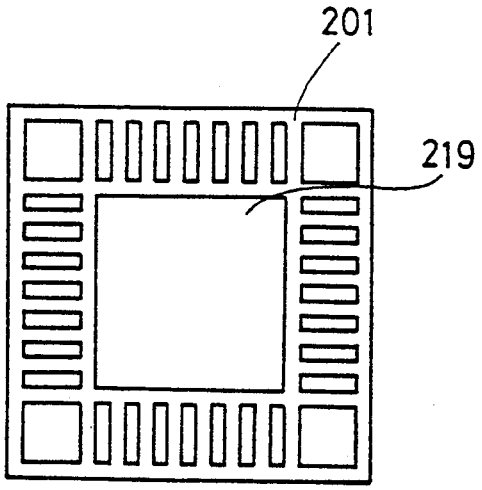

At step 106, after terminals or other necessary portions are formed on the metal base strip 201, the metal base strip 201 with the sintered metal layers 219 embedded therein is cut with a press or other appropriate tool, such that each of the IC lead frames 225 has desired dimensions and a pattern as shown in FIG. 7B.

Figure 9A:
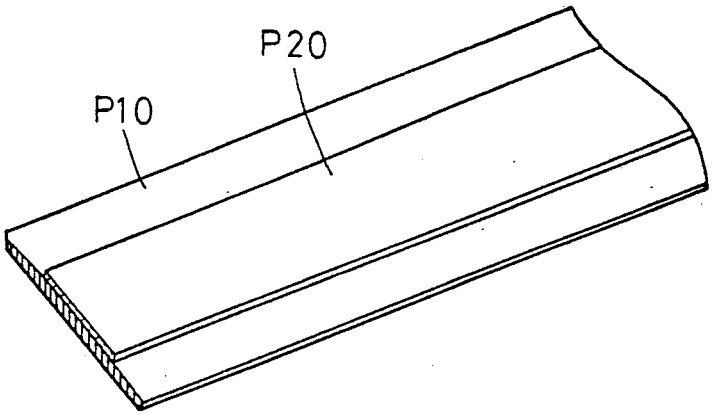
FIG. 9A PRIOR ART
FIGS. 9A and 9B are explanatory views explaining the steps of manufacturing a prior-art contact member strip material.
Figure 9B:
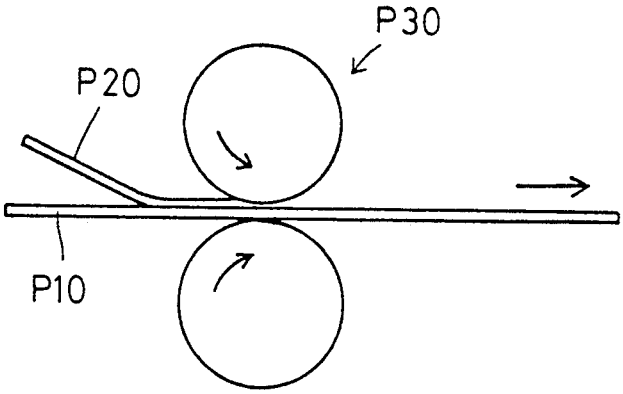
FIG. 9B PRIOR ART

By this method, contact members can be manufactured continuously and more simply as compared with the prior-art method shown in FIGS. 9A and 9B.

Figure 8:
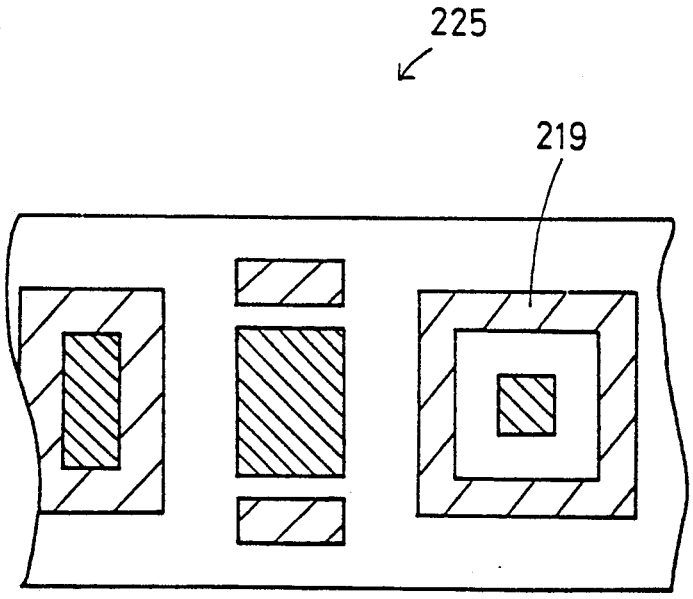
FIG. 8 is a plan view showing modifications to the IC lead frame of the second embodiment.

The printing of the metal paste layers 203 enhances the precision in the arrangement of the sintered metal layers 219. The configuration of the sintered metal layers 219 is, of course, not limited to a square one. As shown in FIG. 8, the IC lead frames 225 can have the sintered metal layers 219 having various configurations. The configuration of the sintered metal layers 219 can be easily changed, as desired, by modifying the configurations of the holes 215 formed in the resin sheet 211. When the metal paste layers 203 are transferred onto the metal base strip 201 by using an application nozzle, the configurations of the sintered metal layers 219 can be easily changed by replacing the application nozzle with another one having a desired configuration. Thus, the method allows great flexibility in the configuration of the sintered metal layers 219. Further, since the sintered metal layers 219 can be formed only at desired positions by the method, the IC lead frame is economical in its use of materials and construction.

The contact members of both embodiments can be composed of multiple laminations by repeating the manufacturing steps.

From the above description of a preferred embodiment of the invention, those skilled in the art will perceive improvements, changes, and modifications. Such improvements, changes and modifications within the skill of the art are intended to be covered by the appended claims. For example, a step of rolling at a draft of 30% or less can be inserted after step 103 of printing, such that the metal paste layer is pressed prior to step 104 of heating. Step 105 of rolling is for applying spring properties to the contact member strip material.

At step 102 of preparing, instead of the hair-line finish, sandblasting, shot blasting, sandpapering or etching, for example, can be used.

The contact member according to the invention is not limited to use as a micromotor brush or an IC lead frame. The contact member can be used as a relay contact or a large-sized motor brush. The method of manufacturing the contact member according to the invention can simplify manufacturing steps and save manufacturing costs, irrespective of the kind of the contact member.

At step 105 of rolling, the work rollers 12 and 221 and the backup rollers 13 and 223 can be replaced with presses.

What is claimed is:

1. An electric contact member strip comprising a metal base member having impressed into a surface thereof a strip of a sintered metal paste, at least at one desired location parallel to and adjacent to a longitudinal edge of the metal base member, said strip of said sintered metal paste comprising, by weight, about 1 to 5% carbon, wherein said sintered metal paste is diffusion bonded to the metal base member.

2. The strip according to claim 1 wherein said metal base member is one of nickel silver, alloy of nickel and iron, phosphor bronze, alloy of beryllium and copper, stainless steel, and spring steel.

3. The strip according to claim 1 wherein the sintered metal paste comprises, by weight, about 65% silver and about 30% palladium.

4. The strip according to claim 1 wherein the sintered metal paste is sintered from a metal paste which comprises, by weight, one of:

a) about 15% epoxy resin, about 15% butyl carbitol, about 66.5% of metal powder, and about 3.5% graphite powder with the metal powder being, by weight, about 70% silver and about 30% palladium; and b) about 85.5% aluminum, about 4.5% carbon powder, about 2% butyl carbitol and about 8% ethyl cellulose.

5. A contact member comprising a metal base elongate member having impressed into a surface thereof a strip of a sintered metal paste, at least at one desired location adjacent to one end thereof, said strip of said sintered metal paste comprising about 1–5% by weight of carbon, wherein said sintered metal paste is diffusion bonded to the metal base elongate member.

6. The contact member according to claim 5 wherein said metal base member is one of nickel silver, alloy of nickel and iron, phosphor bronze, alloy of beryllium and copper, stainless steel, and spring steel.

7. The contact member according to claim 5 wherein the sintered metal paste comprises, by weight, one of:

a) about 65% silver and about 30% palladium; and b) about 95% aluminum.

8. The contact member according to claim 5 wherein the sintered metal paste is sintered from a metal paste which comprises, by weight, one of:

a) about 15% epoxy resin, about 15% butyl carbitol, about 66.5% of metal powder, and about 3.5% graphite powder with the metal powder being, by weight about 70% silver and 30% palladium; and b) about 85.5% aluminum, about 4.5% carbon powder, about 2% butyl carbitol and about 8% ethyl cellulose.

* * * * *